US007024714B1

(12) United States Patent
Yates

(10) Patent No.: US 7,024,714 B1
(45) Date of Patent: Apr. 11, 2006

(54) CELLED SEAT CUSHION

(76) Inventor: Paul M. Yates, 5814 Briar Tree, La Canada, CA (US) 91011

( * ) Notice: Subject to any disclaimer, the term of this patent is extended or adjusted under 35 U.S.C. 154(b) by 0 days.

(21) Appl. No.: 11/111,524

(22) Filed: Apr. 21, 2005

(51) Int. Cl.
*B68G 5/00* (2006.01)

(52) U.S. Cl. ..... 5/654; 5/655.9; 297/452.23

(58) Field of Classification Search ..... 5/653, 5/654, 655.5, 655.9, 909; 297/452.23, 452.26, 297/452.27
See application file for complete search history.

(56) References Cited

U.S. PATENT DOCUMENTS

| | | | | |
|---|---|---|---|---|
| 2,061,664 | A | 11/1936 | Loncoln | |
| 2,575,764 | A | 11/1951 | Morner | |
| 3,112,956 | A | 12/1963 | Schick et al. | |
| 3,323,151 | A | 6/1967 | Lerman | |
| 3,468,311 | A | 9/1969 | Gallagher | |
| 4,190,918 | A | 3/1980 | Harvell | |
| 4,630,863 | A * | 12/1986 | Roberts | 297/219.1 |
| 4,788,730 | A | 12/1988 | Bexton | |
| 4,923,247 | A * | 5/1990 | Malmstrom | 297/4 |
| 5,369,829 | A * | 12/1994 | Jay | 5/654 |
| 5,636,395 | A | 6/1997 | Serda | |
| 5,679,193 | A | 10/1997 | Yates | |
| 5,756,184 | A | 5/1998 | Yates | |
| 5,855,415 | A | 1/1999 | Lilley, Jr. | |
| 5,932,046 | A | 8/1999 | Yates | |
| 6,009,578 | A | 1/2000 | Davis | |
| 6,012,188 | A * | 1/2000 | Daniels et al. | 5/654 |
| 6,117,259 | A | 9/2000 | Yates | |
| 6,202,234 | B1 | 3/2001 | Henderson | |
| 6,226,820 | B1 * | 5/2001 | Navarro | 5/655.5 |
| 6,413,455 | B1 | 7/2002 | Yates | |
| 6,413,609 | B1 | 7/2002 | Yates | |
| 6,498,199 | B1 | 12/2002 | Yates | |
| 6,506,271 | B1 | 1/2003 | Yates | |
| 6,623,847 | B1 | 9/2003 | Yates | |
| 6,677,026 | B1 * | 1/2004 | Yates | 428/137 |
| 6,701,556 | B1 | 3/2004 | Romano et al. | |

* cited by examiner

*Primary Examiner*—Michael Trettel
(74) *Attorney, Agent, or Firm*—Walter A. Hackler

(57) ABSTRACT

A seat cushion includes a flexible base having a pandurate shape symmetrical and foldable along the centerline thereof. An undulant pattern of cells is disposed on one side of the base and extend outwardly from each side of the centerline to a base perimeter with each of the cells being defined by a fabric adhered to the base in the undulant pattern. A gel is provided which fills each of the cells.

16 Claims, 3 Drawing Sheets

13
14
18
16
10
36
26
12
34
32
54
58
40
38
30
28
22
20

CELLED SEAT CUSHION

The present invention is generally related to toteable cushions and is more particularly directed to a cushion utilizing a specific arrangement of gel and foam filled cells.

A great number of cushions have been developed for providing comfort to a users' buttock on both hard and soft surfaces.

Various foams and gels and combination thereof have been utilized in a great variety of densities and thicknesses in order to provide a seat cushion which can provide comfortable, long lasting seating for the users.

However, none of the prior art has utilize a contoured cell structure for supporting the users' buttock, or ischii, without causing pressure to the coccyx.

The present invention provides for such structure.

SUMMARY OF THE INVENTION

A seat cushion in accordance with the present invention generally includes a flexible base having a pandurate shape, which is symmetrical and foldable along a centerline thereof. This structure enables the seat cushion in accordance with the present invention to be collapsed and transported by the user if desired, which is specifically suitable for the use in bleachers, benches, utilized in attendance of public outings including sports events.

An undulant pattern of cells is disposed on one side of the base and extends outwardly from each side of the centerline to a base perimeter.

The cells are defined by a fabric adhered to the base in the undulant pattern. The pattern of the cells provides for confirmation to a users' buttock, thus providing comfort hereinbefore not available by prior art seat cushions.

A gel is provided which fills each of the cells.

More particularly, a second undulant pattern of cells may be disposed on opposite side of the base and extend outwardly from each side of the centerline to the base perimeter. The second undulant pattern of cells is defined by a second fabric adhered to the base in the second undulant pattern. In this embodiment, a foam fills each of the cells of the second undulant pattern.

More particularly, in accordance with the present invention, each of the undulant pattern of cells is spaced apart from the centerline and the seat cushion may further include a carrying handle attached along the centerline between the undulant pattern of the cells.

Still more particularly, the cells may be spaced apart from one another by a junction between the fabric and the base enabling flexure of the cushion longitudinally along the centerline. This feature not only enables confirmation to the surface onto which the seat cushion is disposed, but also accommodates the curvature of the users' buttock.

Still more particularly, the second fabric may be porous and in combination with the foam provides for an insulated breathing arrangement between the users' buttock and the surface onto which the seat cushion is placed.

More specifically, the first and second undulant patterns overlay one another and the second pattern of cells is spaced apart from the centerline for facilitating folding of the seat cushion along the centerline, as hereinabove noted.

Preferably, the first and second patterns have identical undulant, or wave, shapes for providing the accommodation of a users' buttock, as hereinabove noted.

BRIEF DESCRIPTION OF THE DRAWINGS

The advantages and features of the present invention will be better understood by the following description when considered in conjunction with the accompanying drawings in which.

DETAILED DESCRIPTION

Figure 1:
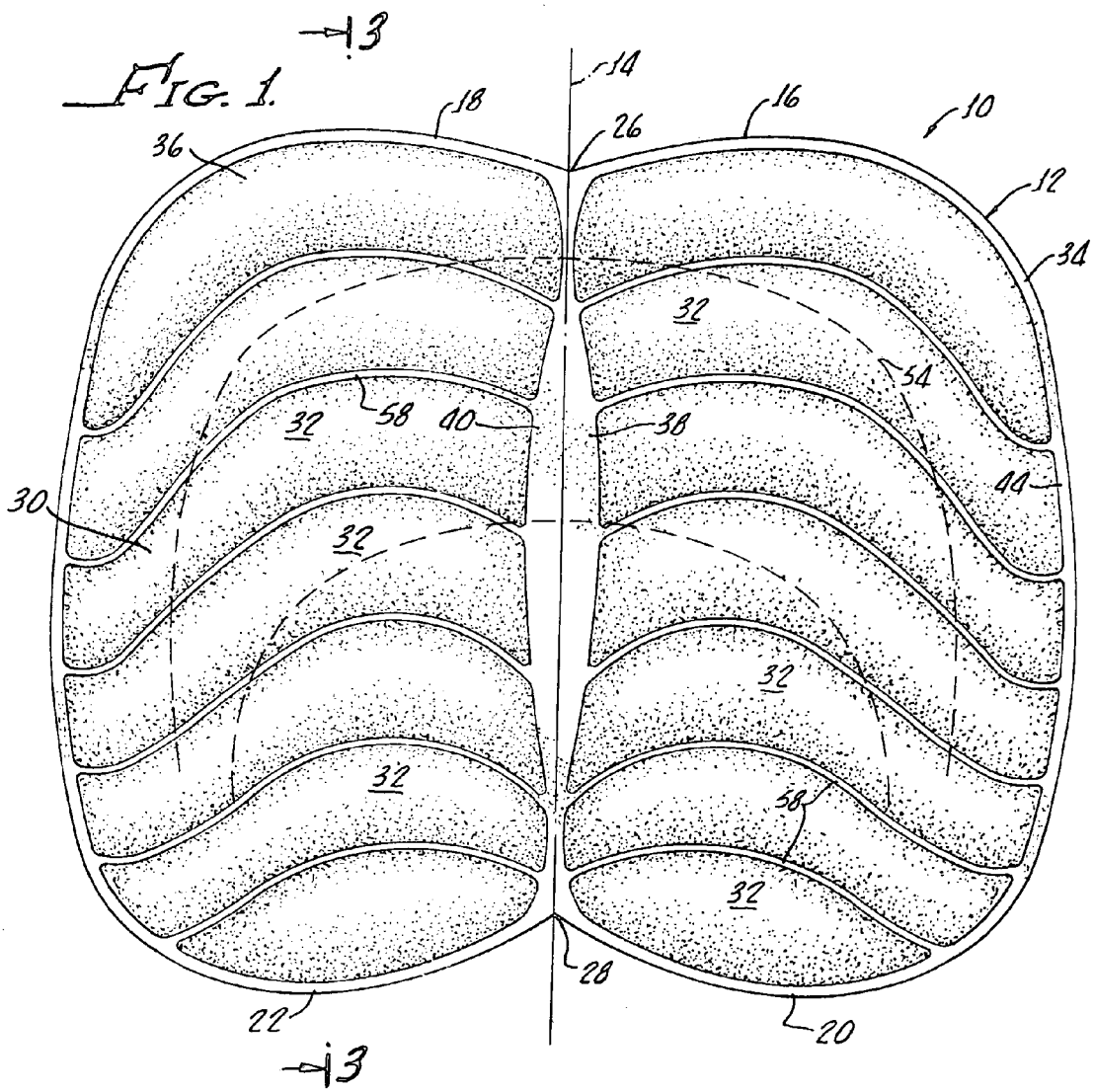
FIG. 1 is a plan view of a cushion made in accordance with the present invention generally showing an undulate pattern of cells disposed thereon.
Figure 2:
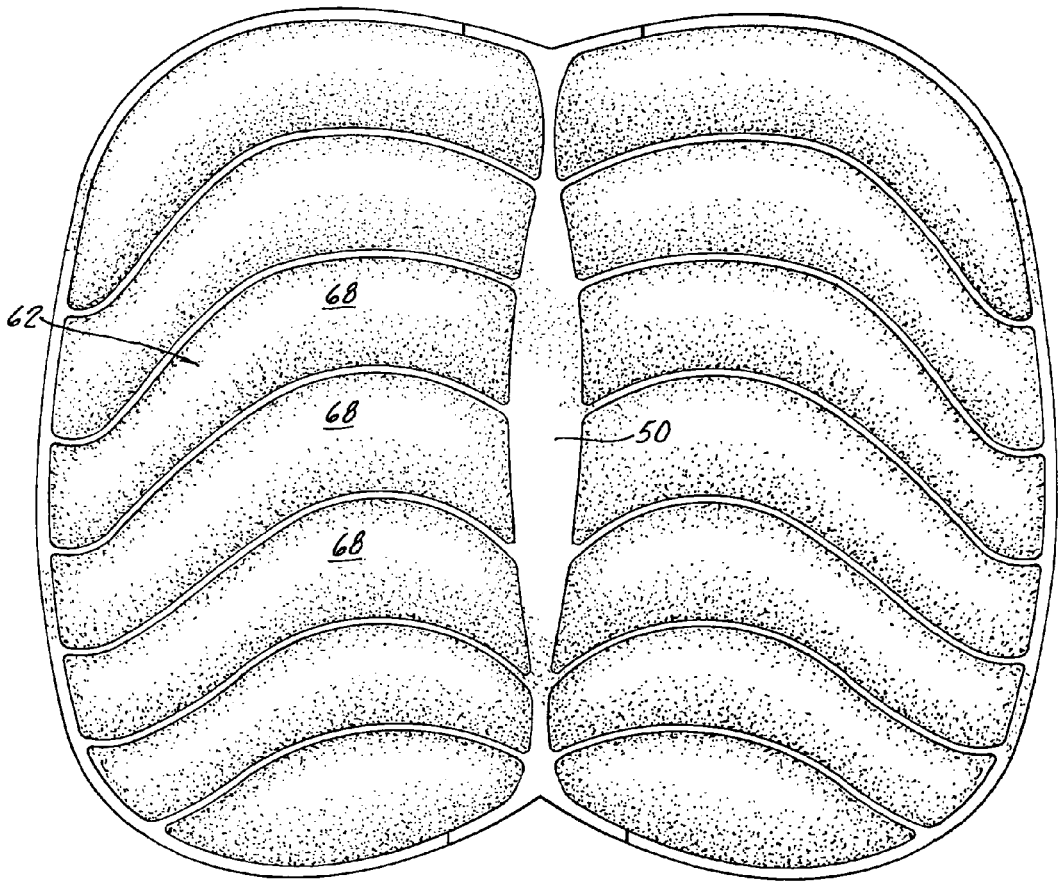
FIG. 2 is a plan view of a top of the cushion shown in FIG. 1 also showing an undulant pattern of cells formed thereon along with a handle.
Figure 3:
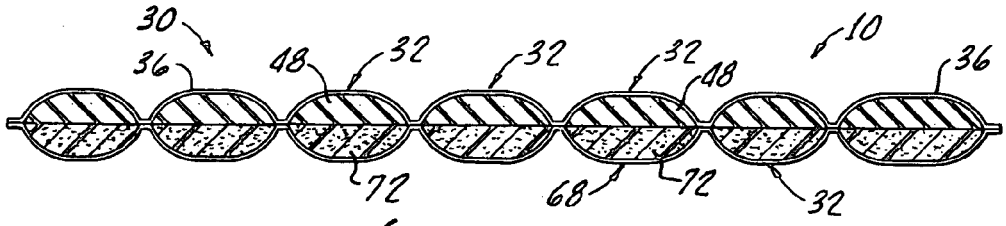
FIG. 3 is a cross sectional view of the undulate cells.
Figure 4:
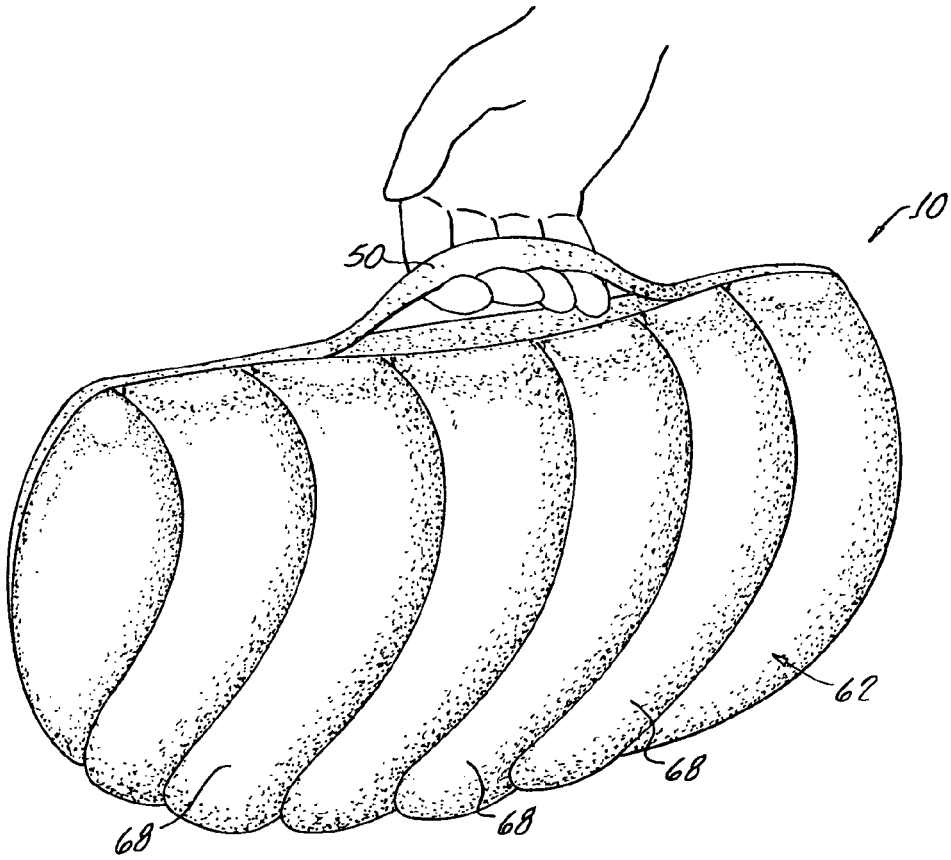
FIG. 4 is a perspective view of the cushion folded enabling transport thereof by the handle 50.

With reference to FIGS. 1 and 2, there is shown a seat cushion 10 in accordance with the present invention having a flexible base 12 with a pandurate shape, which is symmetrical and foldable about a centerline, as shown in FIGS. 3 and 4. The pandurate shape includes rounded ends 16, 18, 20, 22 with contracted centers 26, 28 between the rounded ends 16, 18, and 20, 22 respectively, the contracted centers 26, 28 being disposed along the centerline 12.

An undulant, or wave type, pattern 30 of cells 32, is disposed on the one side 34 of the base and extends outwardly from each side 38, 40 of the centerline 14 to a base perimeter 44.

The cells 32 are defined by a fabric 36, such as, for example, Lycra® adhered to the base 12 in the undulant pattern 30. A gel 48 fills each of the cells 32.

Suitable gels may be formed from polymers which can, for example, include triblock copolymers.

Such polymers can have a wide range of resilient properties when used with varying amounts of plasticizer, for example, plasticizer oil, as is well known in the art. Such triblock copolymers include:

SEBS gels; examples include (a) Kraton G 1651.G 1654X gels; (b) Kraton G 4600 gels; (c) Kraton G 4609 gels; (d) Tuftec H 1051 gels; (e) Tuftec H 1041 gels; (f) Tuftec H 1052 gels.

Gels made from blends (polyblends) of (a)–(f) with other polymers and copolymers include: SEBS-SBS gels; SEBS-SIS gels; SEBS-(SEP) gels; SEBS-(SB)n gels; SEBS-(SEB)n gels; SEBS-(SI)n gels; SEBS-(SI) multiarm gels; SEBS-branched copolymers gels; SEBS-star shaped copolymer gels; gels made from blends of (a)–(f) with other homopolymers include: SEBS/polystyrene gels; SEBS/polybutylene gels; SEBS/polyethylene gels; SEBS/polypropylene gels.

Other suitable thermoplastic elastomers in blends suitable for making gels include SEP/SEBS oil gels, SEP/SEPS oil gels, SEP/SEPS/SEB oil gels, SEPS/SEBS/SEP oil gels, SEB/SEBS, EB-EP/SEBS, SEBS/EB, SEBS/EP, SEPS/SEB, etc.

The following commercial elastomers can be formed with oil and in combination with other polymers into suitable gels for use in making the gel components of the composites of the invention: Shell Kratons D1101, D1102, D1107, D1111, D1112, D1113X, D1116, D1117, D1118X, D1122X, D1125X D1133X, D1135X, D1184, D1188X, D1300X, D1320X, D4122, D4141, D4158, D4240, G1650, G1652, G1657, G1701X, G1702X, G1726X, G1750X, G1765X, FG1901X, FG1921X, D2103, D2109, D2122X, D3202, D3204, D3226, D5298, D5999X, D7340, G1654X, G2701, G2703, G2705, G1705, G2721X, G7155, G7430, G7450, G7523X, G7528X, G7680, G7705, G7702X, G7720, G7722X, G7820, G7821X, G7827, G7890X, G7940; Kuraray's SEP/SEPS/SEEPS: Nos. 1001(SEP), 2002(SEPS), 2003(SEPS), 2023(SEPS), 2043(SEPS), 2063 (SEPS), 2005(SEPS), 2006(SEPS), 1050(SEP), 2103(SEPS), 2104(SEPS), 2105(SEPS), and 4055(SEEPS) manufactured by Kuraray Co., Ltd., wherein SEP is made from hydrogenated styrene isoprene di-block copolymer (SI).

SEPS is made from hydrogenated styrene isoprene tri-block copolymer(SIS), and SEEPS is made from hydrogenated styrene isoprene/butadiene block copolymer or more specifically made from hydrogenated styrene block polymer with 2-methyl-1.3 butadiene and 1.3 butadiene.

The most preferred gels forming the composites of the invention comprise a high viscosity triblock copolymers which have the more general configuration A-B-A wherein each A is a crystalline polymer end block segment of polystyrene; and B is an elastomeric polymer center block segment of poly(ethylene-butylene). The poly(ethylene-butylene) and polystyrene portions are incompatible and form a two-phase system consisting of sub-micron domains of glassy polystyrene interconnected by flexible poly (ethylene-butylene) chains. These domains serve to crosslink and reinforce the structure. This physical elastomeric network structure is reversible, and heating the polymer above the softening point of polystyrene temporarily disrupt the structure, which can be restored by lowering the temperature. This also applies to high viscosity poly (styrene-ethylene-propylene-styrene) triblock copolymers.

Various mixtures of polymer may be used as taught in U.S. Pat. No. 5,633,286 hereinabove cited and incorporated herein by reference.

Plasticizers particularly preferred for use in practicing the present invention are well known in the art, and they include rubber processing oils such as paraffinic and naphthenic petroleum oils, highly refined aromatic-free paraffinic and naphthenic food and technical grade white petroleum mineral oils, and synthetic liquid oligomers of polybutene, polypore, polyterpene, etc. The synthetic series process oils are high viscosity oligomers which are permanently fluid liquid nonolefins, isoparaffins or paraffins of moderate to high molecular weight.

Examples of representative commercially oils include Amoco® polybutenes, hydrogenated polybutenes and polybutenes with epoxide functionality at one end of the polybutene polymer. Examples of such polybutenes include L-14(320Mn), L-50(420Mn), L-100(460Mn), H-15 (560Mn), H-25(610Mn), H-35(660Mn), H-50(750Mn), H-100(920Mn), H-300 (1290Mn), L-14E (27–37 cst @ 100° F. Viscosity), H-300E (635–690 cst @ 210° F. Viscosity), Actipol E6 (365Mn), E16 (973Mn), E23 (1433Mn) and the like. Example of various commercially oils include: ARCO Prime (55, 70, 90, 200, 350, 400 and the like), Duraprime and Tufflo oils (6006, 6016, 6016M, 6026, 6036, 6056, 6206, etc), other white mineral oils include: Bayol, Bernol, American, Blandol, Drakeol, Ervol, Gloria, Kaydol, Litetek, Lyondell (Duraprime 55, 70, 90, 200, 350, 400, etc), Marcol, Parol, Peneteck, Primol, Protol, Sonrex, and the like.

The seat cushion 10 may be formed in accordance with the procedures set forth in U.S. Pat. Nos. 5,679,193, 5,756,184, 5,932,046, 6,117,259, 6,413,455, 6,413,609, 6,498,199, 6,506,271, and 6,623,847 all to Yates. All of these patents are to be incorporated herewith in their entirety by this specific reference thereto for illustrating a method in which the seat cushion of the present invention may be formed.

As shown, the undulant pattern 30 of cells 32 are spaced apart from the centerline 14 and a carrying handle 50 may be attached in any conventional manner along the centerline to the base 12. This enables convenient carrying of the seat cushion 10 in a folded configuration, as illustrated in FIG. 4.

As illustrated in FIG. 1, the undulant pattern 30 conforms to a users' buttock 54 shown in dashed line.

In addition, as illustrated, the cells are spaced apart from one another by a junction 58 between the fabric 36 and the base 12, which enables flexing of the seat cushion 10 longitudinally along the centerline 14.

With particular reference to FIGS. 2 and 3, the cushion 10 further includes a second undulant pattern 62 of cells disposed in the opposite side 64 of the base 12 and extend outwardly from each side 38, 40 of the centerline 14 toward the base perimeter 44.

The second pattern 62 defines cells 68 by a second fabric 70 adhered to the base opposite side 64.

A foam fills each of the cells 68 and the second fabric 70 may be formed from a porous material thus enable breathing of the cushion 10 when disposed on a surface, not shown, and supporting the buttock 54. In addition, the foam 62 provides insulation for hot and cold surfaces (not shown).

The first and second undulating patterns 30, 62 are of the same shape, size, and conformed to one another and overlay one another, thus enabling maximum flexing of the cushion in the longitudinal direction along the centerline 14.

Although there has been hereinabove described a specific celled seat cushion in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A seat cushion comprising:

a flexible base having a pandurate shape symmetrical and foldable along a centerline thereof;

an undulant pattern of cells disposed on one side of the base and extending outwardly from each side of said centerline to a base perimeter, said cells being defined by a fabric adhered to the base in the undulant pattern, said undulant pattern of cells being spaced apart from the centerline;

a gel filing each of the cells; and a carrying handle attached along the centerline.

2. The seat cushion according to claim 1 wherein the undulant pattern conforms to a users' buttock.

3. The seat cushion according to claim 2 wherein the cells are spaced apart from one another by a junction between the fabric on the base enabling flexure of said seat cushion longitudinal along the centerline.

4. The seat cushion according to claim 3 further comprises a second undulant pattern of cells disposed on an opposite side of the base and extending outwardly from each side of said centerline toward the base perimeter, said second pattern of cells being defined by a second fabric adhered to the base in the second undulant pattern and a foam filling each of the cells of the second pattern.

5. The seat cushion according to claim 4 wherein said second fabric is porous.

6. The seat cushion according to claim 5 wherein the first and second undulant pattern overlay one another.

7. The seat cushion according to claim 6 wherein said second pattern of cells is spaced apart from the centerline facilitating folding of said seat cushion along the centerline.

8. The second cushion according to claim 7 wherein the first and second pattern of cells are undulant in shape.

9. A seat cushion comprising:

a flexible base having a pandurate shape symmetrical and foldable along a centerline thereof;

an undulant pattern of cells disposed on one side of the base and extending outwardly from each side of said centerline to a base perimeter, said cells being formed by a fabric adhered to the base in the undulant pattern;

a second undulant pattern of cells disposed on an opposite side of the base and extending outwardly from each side of said centerline to the base perimeter, said second undulant pattern of cells being defined by a second fabric adhered to the base in the second undulant pattern;

a gel filling each of the cells of the undulant pattern; and a foam filling each of the cells of the second undulant pattern.

10. The seat cushion according to claim 9 wherein the undulant pattern of cells is spaced apart from the centerline and said seat cushion further comprises a carrying handle attached along the centerline.

11. The seat cushion according to claim 9 wherein the undulant pattern conforms to a users' buttock.

12. The seat cushion according to claim 11 wherein the cells are spaced apart from one another by a junction between the fabric on the base enabling flexure of said seat cushion longitudinal along the centerline.

13. The seat cushion according to claim 12 wherein said second fabric is porous.

14. The seat cushion according to claim 13 wherein the first and second undulant pattern overlay one another.

15. The seat cushion according to claim 14 wherein said second pattern of cells is spaced apart from the centerline facilitating folding of said seat cushion along the centerline.

16. The second cushion according to claim 15 wherein the first and second pattern of cells are ulant in shape.

* * * * *